United States Patent [19]

Main

[11] 4,223,544

[45] Sep. 23, 1980

[54] DIE LUBRICANT NOZZLE FOR USE IN CAN BODYMAKERS AND THE LIKE

[75] Inventor: Ralph M. Main, San Pedro, Calif.

[73] Assignee: Standun, Inc., Compton, Calif.

[21] Appl. No.: 609,427

[22] Filed: Sep. 2, 1975

[51] Int. Cl.[3] ..... B21D 22/28

[52] U.S. Cl. ..... 72/45; 72/349; 184/6.14

[58] Field of Search ..... 184/1 R, 1 E, 6.14; 72/347-349, 41, 43, 44, 45; 308/5 R, 240

[56] References Cited

U.S. PATENT DOCUMENTS

| | | | |
|---|---|---|---|
| 2,593,116 | 4/1952 | Danly et al. | 184/6.14 |
| 2,821,156 | 1/1958 | Lyon | 72/348 |
| 3,577,753 | 4/1971 | Shah et al. | 72/349 |
| 3,653,249 | 4/1972 | Dunn | 72/349 |
| 3,837,659 | 9/1974 | Moncrief | 184/1 E X |

*Primary Examiner*—David H. Brown
*Attorney, Agent, or Firm*—Mahoney & Schick

[57] ABSTRACT

A reciprocal ram carries a metallic cup on an end thereof axially through a die pack opening and a die ring thereof in a working metal forming stroke, the cup is stripped therefrom and the ram moves reversely through the die ring in a return stroke. An annular lubricant nozzle surrounding the die pack opening forwardly adjacent the die ring directs an annular flow of lubricant continuously axially along and against an angled die ring entrance surface to a die ring forming surface during presence of the cup therein, and over the die ring forming surface and through natural adherence along a die ring angled exit surface during lack of presence of the cup regardless of the ram position in its strokes. The nozzle also preferably directs the lubricant constantly impinging on an exposed leading end surface of the die ring and preferably the outer of nozzle angled and parallel internal annular surfaces is formed by a separately mounted lubricant distribution ring, the exact ring mounting determining the nozzle lubricant direction and flow volume.

12 Claims, 5 Drawing Figures

DIE LUBRICANT NOZZLE FOR USE IN CAN BODYMAKERS AND THE LIKE

BACKGROUND OF THE INVENTION

This invention relates to a die lubricant nozzle for use in can bodymakers and the like, and more particularly, to a die lubricant nozzle of the type surrounding the ram opening of a tool pack axially preceding a die ring thereof and directing lubricant into the tool pack opening for providing lubrication and cooling during metal working operations on cups carried through the die pack by the ram. According to the improvements of the present invention, the die lubricant nozzle directs an annular lubricant flow continuously along and against die ring angled entrance surfaces of an axially adjacent die ring and to the die ring forming surface regardless of the particular position relative to the die ring of the cup being carried by the ram and formed by the die ring. Furthermore, when the cup is not in the die ring and regardless of the relative position of the ram, whether extending through the die ring or completely displaced therefrom, the die lubricant nozzle of the present invention not only directs the annular lubricant flow along and against the die ring angled entrance surfaces to the die ring forming surface, but also over such forming surface and along the die ring angled exit surface as a result of natural adherence of the lubricant to the die ring surfaces.

In a modern can bodymaker, an axially reciprocal ram ready for the start of its working metal forming stroke is positioned totally withdrawn from the bodymaker die pack and a previously blanked and drawn, shallow metallic cup is fed into axial alignment with the ram end portion, the cup opening facing the ram end portion. With the cup so located, the ram moves fully into the cup and begins carrying the same into the entrance of the die pack opening and subsequently through a redraw die ring, if the same is provided, and ultimately through a series of usually two or more axially spaced ironing rings, ultimately exiting the die pack by merely passing through a usual stripper without any stripping action of the cup from the ram. With the ram extending axially completely through the die pack and the cup now of greatly lengthened and thin-walled formation, the ram completes its working metal forming stroke by forcing the cup bottom wall against a doming die surface for finally appropriately metal forming the cup bottom wall into final shape whereupon the ram reverses its axial movement and begins its reverse return stroke.

At initiation of the ram reverse return stroke, the now formed cup in final can body form still remains adhering to the ram end portion so that as the ram returns through the stripper, the now formed cup is engaged by the stripper and retained stationary while the ram continues its return stroke movement to thereby remove the cup from the ram. With the ram continuing its return stroke movement, it withdraws from the die pack through the series of ironing die rings and the redraw die ring ultimately totally withdrawing from the die pack and completing its reverse return stroke by assuming its original position spaced from the entrance of the die pack. The next to be formed shallow cup is then fed into location at the entrance to the die pack, the ram starting its next working metal forming stroke moves into engagement with the cup and the entire cycle is repeated.

To bring these ram reciprocal movement and cup metal forming operations into proper prospective, it is pointed out that a modern can bodymaker operates at speeds in the order of 150 to 175 complete cup metal forming cycles per minute. The metallic cups formed of either aluminum or tin plate in the starting, shallow cup state have wall thicknesses in the order of 13 to 14 thousandths of an inch and in the final wall lengthened state have wall thicknesses in the order of 4 to 5 thousandths of an inch. Thus, it can be very well appreciated that the various metal forming operations performed by the various die rings of the die pack are extremely delicate metal forming operations at high, heat generating speeds requiring efficient die lubricant flow for maximizing lubrication and cooling. Consequently, it is imperative that individual coolant nozzle structures be located in the die pack ahead of at least the individual ironing die rings in view of these ironing die rings being located well internally of the die pack and otherwise quite inaccessible for directing a lubricant flow thereto.

For instance, with the metallic cups being carried through the ironing die rings at the extremely high speeds, lubricant must be constantly present in order that the wall ironing metal working operations can be consistently and uniformly carried out. At the same time, the constant generation of heat from such metal working operations as the result of the ironing die ring and metallic cup surfaces contacting at these high speeds must be dissipated in order that such temperatures will be maintained relatively uniform over a reasonable range so as to maintain uniformity of metal working and uniformity of the final cup products. A still further factor of vital concern is occasioned by build up on the ironing die surfaces and cup surfaces of various forms of extraneous debris, both metallic and otherwise, which can inhibit uniformity and predictability of relatively delicate metal forming operations as are herein involved. The lubricant, therefore, is desired under optimum conditions to be a constantly flowing and overall metal surface covering lubricant, most importantly, constantly present and flowing over surfaces in metal-to-metal contact, in order to perform these combined lubricating, heat dissipating and washing functions.

Various forms of prior die lubricant nozzle constructions attempting to satisfy these optimum conditions have heretofore been provided, one of which having the purpose of directing a continuous, annular flow of lubricant surrounding and against the sidewalls of the cups during their axial movement through a particular ironing die ring. More specifically, the annular coolant flow is directed into the die pack opening spaced axially ahead of the particular ironing die ring so that as the cups are carried axially through the die pack opening by the ram, this annular coolant flow will impinge against the sidewalls of the cups and due to the axial movements of the cups will be carried by the cup surfaces to the ironing die ring metal forming surfaces. One of the principle difficulties with this construction of die lubricant nozzle in attempting to satisfy the foregoing optimum conditions is that, at best, the only time that a constant lubricant flow is maintained over the ironing die ring surfaces, and then only over the exact metal working surfaces thereof, is during the short interval of presence of a cup passing through the ironing die ring. At all other times, whether or not the ram alone is present, the lubricant flow is always spaced from the die ring surfaces and there is not the continuous lubricant flow against these die ring surfaces for heat dissipation and debris washing and removal.

Another prior form of die lubricant nozzle construction has included a series of circumferentially spaced jets positioned around the die pack opening similarly spaced ahead of the particular ironing die ring, but directing jets of coolant diametrically across the tool pack opening at an axial angle sufficient to impinge the jets of coolant against the particular ironing die ring at the diametrically opposite side of the tool pack opening when the cup and ram or the ram alone are not present. When the cup is present, the same moderate lubrication for only the die ring metal working portion is supplied, and when the ram alone is present in either of its working metal forming or reverse return strokes, the lubricant cannot contact the ironing die ring at all, while during the period that the ram is forwardly of the ironing die ring in portions of either of its strokes, the lubricant can pass diametrically across the tool pack opening and impinge against the exposed surfaces of the ironing die ring. Obviously, if the diametrical coolant jets are spaced sufficiently close together, a relatively steady flow of coolant of moderate flow intensity can be supplied to the metal working portion of the ironing die ring during the actual metal working operation as in the previously discussed prior construction, but otherwise there is no heat dissipating and debris washing and removal function accomplished except during the partial cycle short periods of time when the ram is removed from the ironing die ring at the forward portions of these strokes. Thus, some metal working operation lubrication and some heat dissipation and debris washing and removal slightly improved over the above discussed prior construction while still not very closely approaching the optimum desired conditions.

OBJECTS AND SUMMARY OF THE INVENTION

It is, therefore, an object of this invention to provide a die lubricant nozzle for use in the die packs of can bodymakers and the like which satisfies virtually the optimum conditions of constant lubrication, heat dissipation and debris washing and removal for metal working die rings as hereinbefore discussed. In the preferred form, a continuous annular flow of lubricant is directed by the unique nozzle fully along and against the entrance surfaces of the die ring and to the metal working surfaces thereof regardless of the presence or lack of presence of the cup being formed or the ram. Furthermore, during the ram cycle periods when the cup is not present, and whether or not the ram is present, the annular lubricant flow by the unique nozzle is not only continuously over the die ring entrance surface to the metal working surfaces thereof, but also continuously over the metal working surfaces and along the die ring exit surfaces. As a result, maximum lubrication, heat dissipation and debris washing and removal operations are efficiently accomplished.

It is a further object of this invention to provide a die lubricant nozzle of the foregoing general type which, in the preferred embodiment form, provides even further improved cooling attributes. In this preferred form, the elements forming the die lubricant nozzle are directly axially adjacent the leading end surface of the particular die ring and these nozzle elements are formed to fully expose a portion of this die ring leading end surface. Thus, not only is the die lubricant nozzle formed to direct the annular lubricant flow along and over the various die ring surfaces as hereinbefore described, but the annular lubricant flow is also directed to impinge against these exposed die ring leading end surfaces. This thereby follows the fundamental principle of increasing the heat dissipation from the die ring by increasing the surface of contact of the die ring by the heat dissipating lubricant flow.

It is still a further object of this invention to provide a die lubricant nozzle having one or more of the foregoing attributes wherein, again in the preferred form, unique adjustability of the lubricant flow from the nozzle is provided merely through the selected mounting of one of the elements thereof so as to add versatile adaptability for varying die ring conditions. The annular lubricant flow is produced by generally radially spaced, annular surfaces and the radially outward of these nozzle surfaces is preferably formed by a selectively mountable lubricant distribution ring. Thus, merely by the selection of the mounting of this lubricant distribution ring, the formation of the lubricant nozzle can be readily varied to adapt the same to the particular conditions as dictated by the particular die ring and the particular extension of the surfaces thereof, all in keeping with the overall object of optimum lubricant flow conditions.

Other objects and advantages of the invention will be apparent from the following specification and the accompanying drawings which are for the purpose of illustration only.

Figure 1:
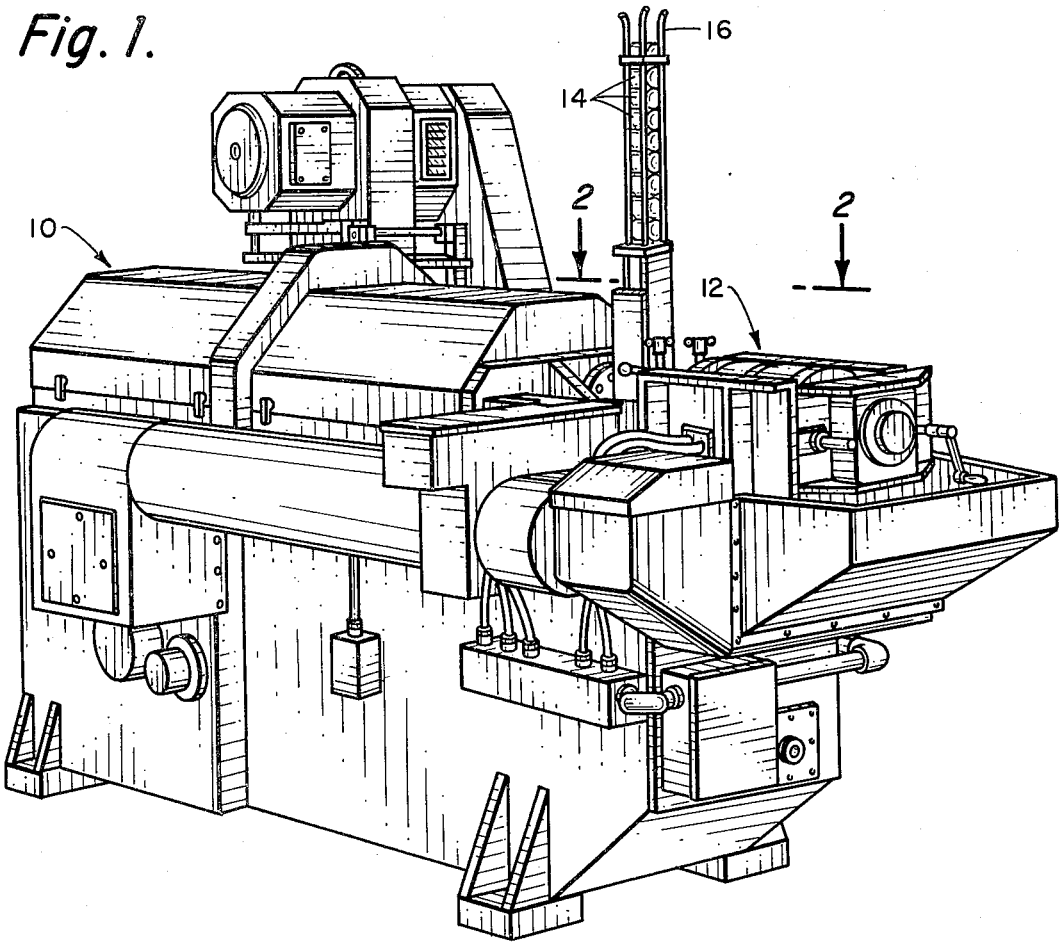
FIG. 1 is a perspective view of a typical can bodymaker illustrating an appropriate environment for the unique die lubricant nozzle principles of the present invention
Figure 2:
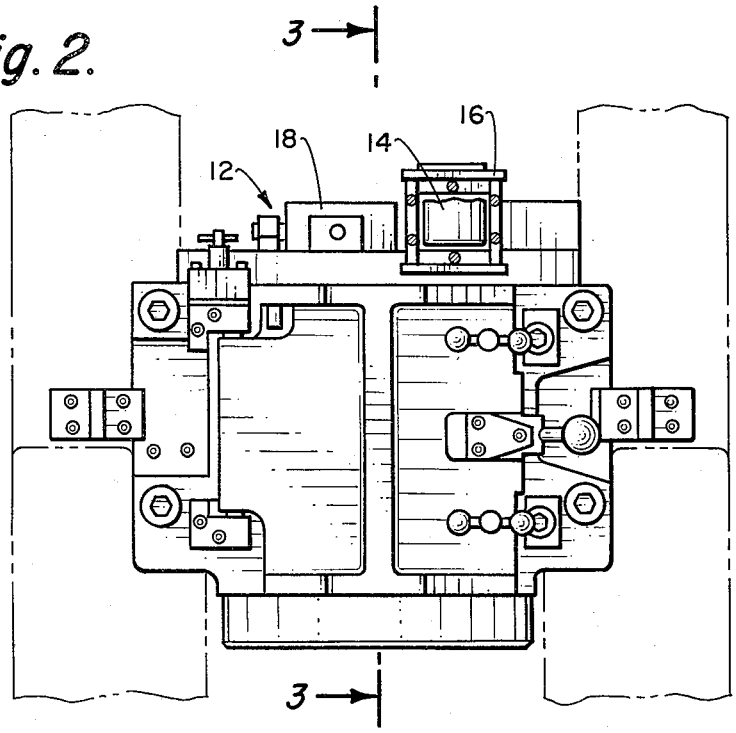
FIG. 2 is an enlarged, fragmentary, top plan view of the die pack of the can bodymaker of FIG. 1 and looking in the direction of the arrows 2—2 in FIG. 1.
Figure 3:
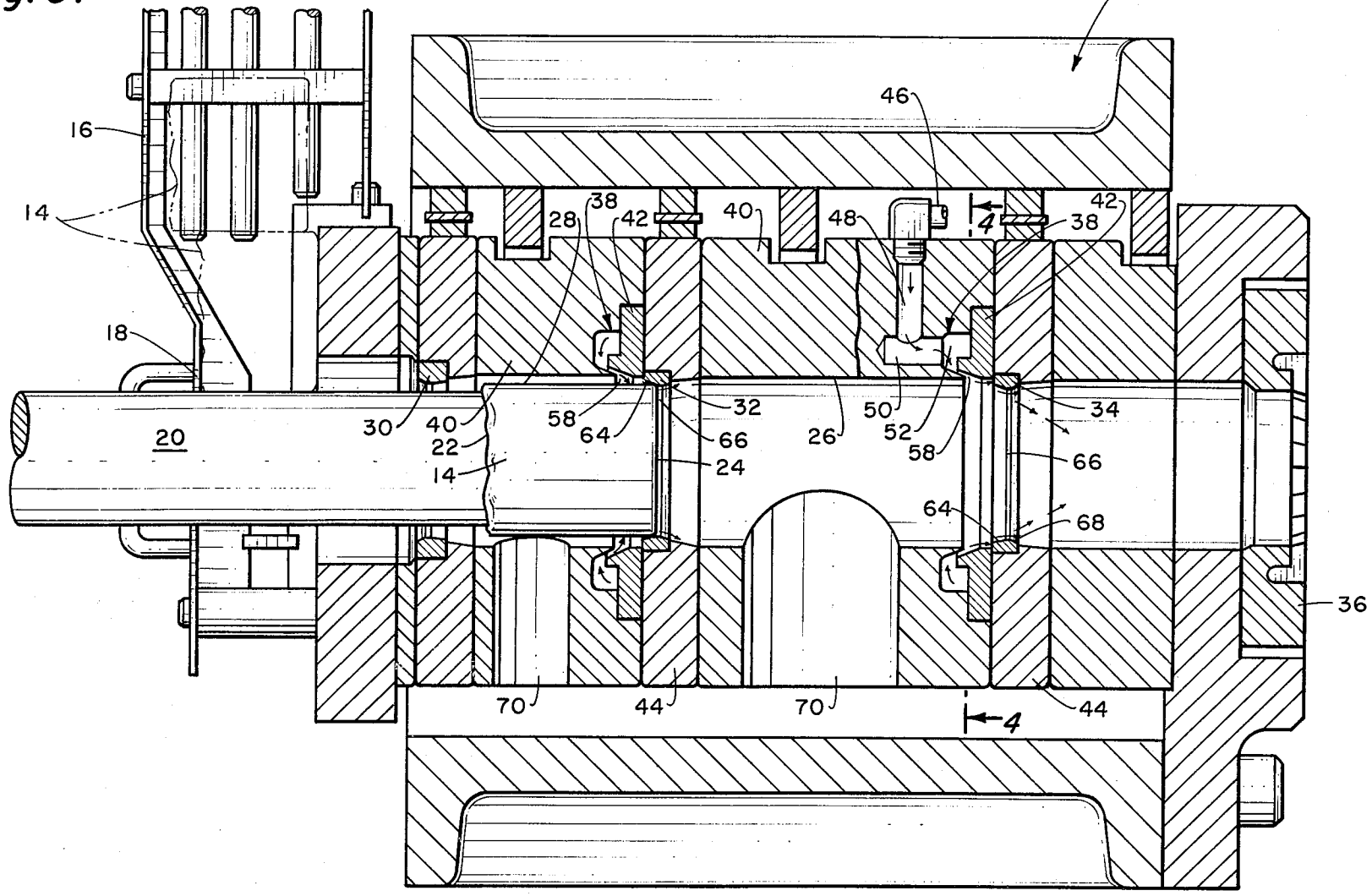
FIG. 3 is an enlarged, fragmentary, vertical sectional view looking in the direction of the arrows 3—3 in FIG. 2 and showing two of the die lubricant nozzles of the present invention installed in the die pack of FIG. 2.

DESCRIPTION OF THE BEST EMBODIMENT CONTEMPLATED:

Referring for the moment only to FIGS. 1 through 3, a typical can bodymaker generally indicated at 10 is shown for the purpose of forming the background environment for use of the die lubricant nozzle principles of the present invention. In the can bodymaker 10, the die lubricant nozzle principles of the present invention are applied to a typical die assembly or die pack generally indicated at 12, all of which will be hereinafter explained more in detail. It is pointed out, however, that the die lubricant nozzle principles of the present invention are applicable to other types of die assemblies used with other types of machinery and that the use shown herein in the can bodymaker 10 is merely a typical use so that it is not intended thereby to limit the principles of the present invention beyond the limitations set forth in the appended claims.

More specifically relative to the can bodymaker 10, semi-finished, shallow metallic cups 14 are fed inwardly in an in-feed assembly 16 one at a time into a cup positioner 18 at which time, a horizontally axially reciprocal ram 20 is withdrawn from the die pack 12 and the cup positioner 18 or to the left as shown in FIG. 3 ready for the ram working metal forming stroke. As positioned in the in-feed assembly 16, the particular shallow cup 14 has an open end 22 axially facing the now withdrawn ram 20, a closed bottom wall 24 axially facing oppositely a die pack axial opening 26 and a cylindrical side wall 28 exactly radially aligned with both the ram 20 and the die pack axial opening 26. Thus, at the beginning of the working metal forming stroke of the ram 20, the ram begins axial movement to the right as shown in FIG. 3 entering the open end 22 of the shallow cup 14 ultimately against the cup bottom wall 24 and carries the cup axially to the right into the entrance end of the die pack axial opening 26.

As the ram 20 progresses into the axial opening 26 of the die pack 12, the ram carries the shallow cup 14 initially through a redraw die ring 30 and then progressively through a series of ironing die rings, in this case, a first ironing die ring 32 and then a second ironing die ring 34. Ultimately, the forward end of the ram 20 with the now side wall lengthened, finished cup thereon (not shown) passes axially through a stripper 36, from the main portion of the die pack 12 and the exit end of the die pack axial opening 26 with the ram 20 completing its working metal forming stroke by forcing the finished cup axially against a bottom forming die (not shown) spaced axially from the stripper. The ram 20 then immediately reverses and begins its reverse return stroke beginning to axially withdraw relative to the die pack 12.

As this return axial movement of the ram 20 progresses carrying the finished cup on the ram forward end, the open end of the finished cup, previously the open end 22 of the shallow cup 14, engages the stripper 36 with the stripper in its usual function resisting further axial movement of the finished cup while the ram continues to progress axially, thereby stripping the finished cup from the ram and permitting the finished cup to fall downwardly for conveyance away from the can bodymaker 10. The ram 20 continues reverse axially forwardly or to the left as shown in FIG. 3 in its reverse return stroke and without any cup on the forward end thereof, such ram remains at all times spaced slightly inwardly from all of the ironing die rings 32 and 34 and the redraw die ring 30.

The ram 20 finally completes its reverse return stroke by completely axially withdrawing to the left as shown in FIG. 3 of the die pack 12 and the in-feed assembly 16 where it axially reverses and is again ready for the start of another working metal forming stroke. At this moment, the next shallow cup 14 of the in-feed assembly 16 is fed into the cup positioner 18 ready to be picked up by the forward end of the ram 20 to start a metal forming operation thereon. As is hereinbefore pointed out, these metal forming operations are carried out by a modern can bodymaker such as the can bodymaker 10 at the rate of between 150 and 175 cycles per minute and the metal thicknesses of the side walls 28 on the shallow cups 14 are reduced from 13 to 14 thousandths of an inch down to 4 to 5 thousandths of an inch.

In view of the high metal working speeds involved and the metal working operations performed at such speeds on the thin metallic cup walls, it is imperative that a continuous flow of lubricant be provided for lubricating between the metallic cup and die ring surfaces during these metal forming operations. Also, it is further desirable to make use of the lubricant flow at times other than at the exact moments of the metal working operations for dissipating the heat built up in the die rings from the metal working operations and to maintain the surfaces of these die rings clean and free of usual debris collection, all for maintaining uniformity of metal working operations throughout the long periods of use. To attain these stated goals becomes particularly troublesome relative to the first and second ironing die rings 32 and 34 as shown in FIG. 3 due to their locations well internally of the die pack 12 and the lack of exterior accessibility thereto, thus the prime purposes of the novel die lubricant nozzle principles of the present invention.

Figure 4:
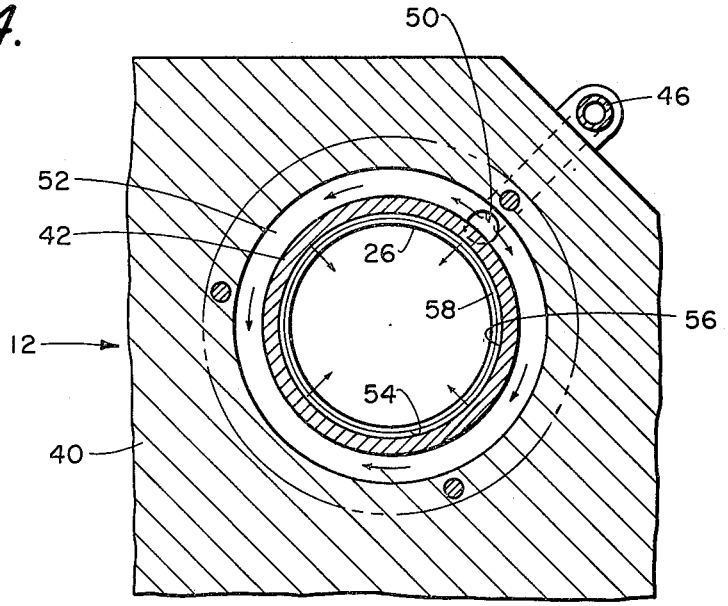
FIG. 4 is a fragmentary, vertical sectional view looking in the direction of the arrows 4—4 in FIG. 3.
Figure 5:
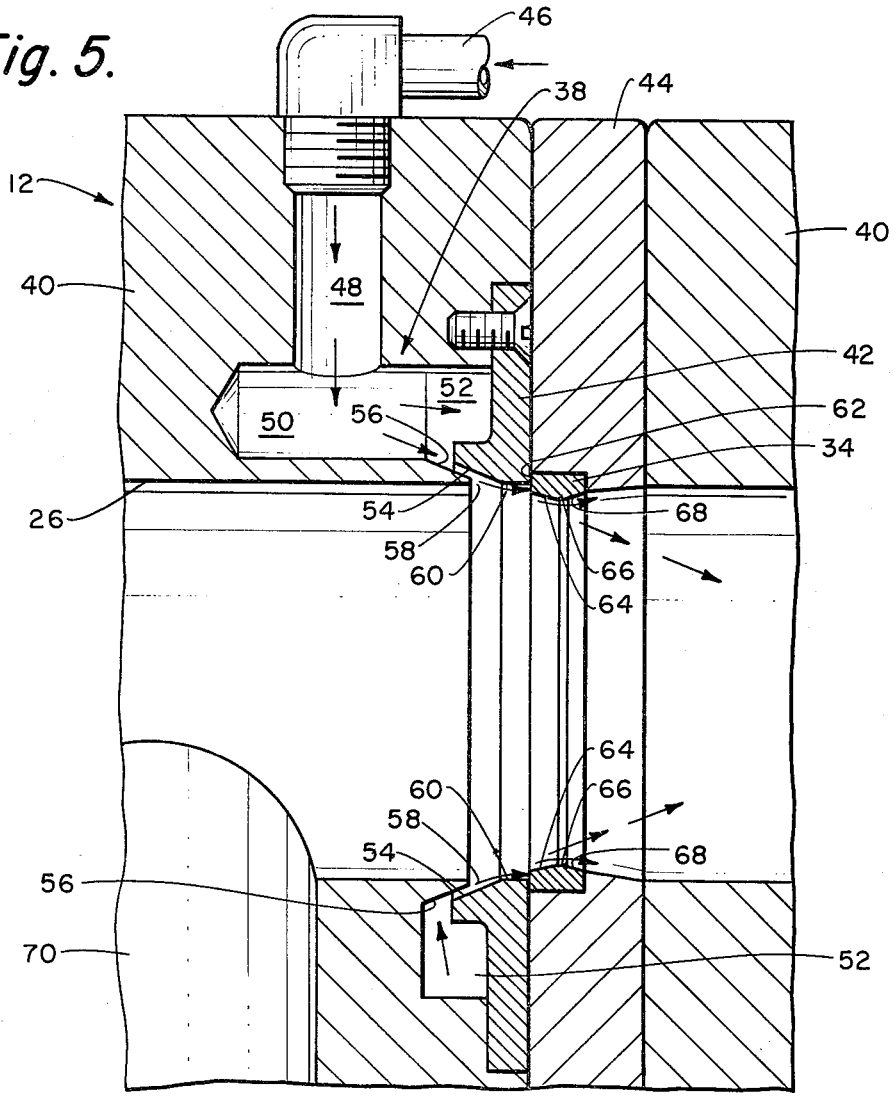
FIG. 5 is an enlarged, fragmentary, vertical sectional view taken from FIG. 3 and more clearly showing the rearward of the die lubricant nozzles of FIG. 3.

Referring to FIGS. 3, 4, and 5, according to the present invention, an improved die lubricant nozzle generally indicated at 38 is installed in the die pack 12 positioned axially forwardly adjacent each of the first and second ironing die rings 32 and 34. As shown, the die lubricant nozzles 38 are formed partially by die pack spacer rings 40 and partially by separate, but assembled, lubricant distribution rings 42, the details of which will be hereinafter described. Furthermore, the die pack spacer rings 40 axially forwardly abut mounting rings 44 for the first and second ironing die rings 32 and 34 within the die pack 12.

As best seen at the rearward of the die lubricant nozzles 38 in FIG. 3, and shown in enlarged views in FIGS. 4 and 5, each of the die lubricant nozzles 38 includes a lubricant supply pipe 46 connected directing a continuous pressurized flow of an appropriate lubricant, such as water soluble oil, through a radial lubricant supply opening 48, through an axial lubricant supply opening 50 and into an annular lubricant distribution chamber 52. This latter annular lubricant distribution chamber 52 surrounds the die pack axial opening 26 and is axially rearwardly nearly closed by the lubricant distribution ring 42. The lubricant distribution ring 42 is received in an appropriate recess at the rearward radial surface of the particular spacer ring 40 selectively removably mounted secured to such spacer ring.

Furthermore, the lubricant distribution ring 42 terminates radially inwardly in an angled, annular surface 54 spaced generally radially outwardly from and preferably parallel to a similar angled annular surface 56 on the particular spacer ring 40, both surfaces extending generally axially between the lubricant distribution chamber 52 and the die pack axial opening 26 thereby forming an annular lubricant orifice 58 surrounding the die pack axial opening. At the axial rearward termination of the angled annular surface 54 of the lubricant distribution ring 42, the lubricant distribution ring is formed with an annular, direct axial surface 60 completing the inner annular extremities of the lubricant distribution ring and terminating rearwardly against a usual radial leading end surface 62 of the particular ironing die ring, in this case, the second ironing die ring 34. It will be noted, according to the preferred embodiment of the present invention, that this annular, direct axial surface 60 of the lubricant distribution ring 42 intersects the radial leading end surface 62 of the second ironing die ring 34 radially intermediate this die ring leading end surface so as to, in effect, form a cut-out forwardly axially exposing a liberal portion of this die ring leading end surface. The remainder of the ironing die rings 32 and 34 are also formed in usual manner with an inwardly angled entrance surface 64 axially rearwardly to a metal forming surface 66 and ultimately to an outwardly angled exit surface 68.

Again according to the optimum principles of the present invention, the angled annular surfaces 54 and 56 of the lubricant distribution ring 42 and the spacer ring 40, respectively, are positioned precisely forming the annular lubricant orifice 58 so that this lubricant orifice directs pressurized lubricant from the lubricant distribution chamber 52 angularly axially into the die pack axial opening 26 exactly axially along and radially against the axially rearwardly adjacent entrance surfaces 64 of the particular ironing die ring, in this case, the second ironing die ring 34. At the same time, with the cut-out as before described, this pressurized lubricant flow will preferably axially impinge against the exposed portion of the die ring leading end surface 62. The overall result is that during the relatively short periods of presence of a cup 14 in and being metal worked by the particular ironing die ring 32 or 34, the annular pressurized lubricant flow from the annular lubricant orifice 58 will continuously flow along and against the die ring angled entrance surface 64 to the die ring metal forming surface 66 completely circumferentially around the particular die ring, and during lack of presence of a cup regardless of the position of the ram 20, such lubricant flow will not only be along and against the angled entrance surface 64 to the metal forming surface 66, but through natural adherence of the lubricant to the die ring surfaces will flow over the metal forming surface 66 and rearwardly along the die ring angled exit surface 68. At all times, the annular lubricant flow will impinge against the exposed leading end surface 62 of the particular ironing die ring 32 or 34.

To apply these principles of the present invention to the cup forming cycling of the can bodymaker 10, as shown in FIG. 3, the cup 14 on the forward end of the ram 20 has the bottom wall 24 thereof just entering the first ironing die ring 32 with the cup side wall 28 radially inwardly of the die angled entrance surface 64. At this particular moment and for the short period that the cup 14 is within the first ironing die ring 32, the same being true of the second ironing die ring 34 when the cup is therein, the continuous annular lubricant flow from the annular lubricant orifice 58 is most importantly directly along and against the die ring angled entrance surface 64 to the die ring metal forming surface 66, with a portion of this lubricant flow also being angularly rearwardly against the part of the cup side walls 28 as they enter the die ring as well as a portion thereof impinging axially against the exposed portion of the die ring leading end surface 62. Thus, even when the cup 14 and necessarily also the ram 20 are present in the ironing die ring 32 or 34, a continuous full annular flow of lubricant is not only against the cup side walls 28 for lubricating the same, but also directly along and against the die ring angled entrance surface 64 to the axial metal forming surface 66 for continuously lubricating the same. Otherwise, this same annular lubricant flow, even during this axial metal working operation, is continuously dissipating heat from both the cup and die ring metals and as augmented by the lubricant flow direct impingment against the die ring leading end surface 62, and continuously washing and removing debris including dirt and metal particles from the die metal working area.

As shown at the rearward second ironing die ring 34 in FIGS. 3 and 5, when the cup 14 is not present in the particular ironing die ring and whether or not the ram 20 alone is present in view of its inward radial spacing from the ironing die ring, the annular lubricant flow is continuously along and against the die ring angled entrance surface 64, over the die ring metal forming surface 66 and through natural adherence thereto along the die ring angled exit surface 68, with portions thereof still continuously impinging against the die ring leading end surface 62. At this time, therefore, which would be during the major portion of the overall cycles of the can bodymaker 10, the annular lubricant flow is continuously dissipating heat and washing and removing debris from the axially adjacent metal and metal surfaces of the particular ironing die ring 32 or 34. Throughout this continuous lubricant flow, the lubricant exits from the die pack axial opening 26 at the ends thereof and downwardly through appropriate drain openings 70 of the spacer rings 40.

Additionally according to the optimum principles of the present invention, with the die lubricant nozzle 38 having the annular lubricant orifice 58 thereof partially formed by the separately mounted lubricant distribution ring 42, the direction and size of the annular lubricant orifice 58 may be selectively changed and exactly regulated merely by selective mounting of the particular lubricant distribution ring 42. Obviously, since the lubricant distribution ring 42 is separately removably mounted, the surfaces thereof may be selectively changed and even usual shims may be used to enlarge, reduce or change the annular direction of the annular lubricant orifice 58 as desired. In this manner, therefore, the proper desired and intended annular lubricant flow may be provided regardless of the particular form and shape of the adjacent die rings being continuously lubricated, cooled and cleaned.

Finally, and as hereinbefore described, the die lubricant nozzles 38 in this preferred embodiment have the lubricant orifices 58 formed as annular lubricant orifices by the angled annular surfaces 54 and 56 of the die pack spacer rings 40 and lubricant distribution rings 42, respectively. It is pointed out, however, that according to the principles of the present invention, the basic intent is to ultimately provide a substantially total annular lubricant flow along and against the surfaces of the particular die rings. Thus, such an intended annular lubricant flow obviously could be provided by a similar orifice arrangement comprised of a multiplicity of circumferentially closely adjacent individual openings or jets since the actual lubricant flow once exiting the orifice arrangement would assume the same virtually complete annular pattern, and such minor alterations in the overall construction are fully contemplated within the broad principles of the present invention.

According to the principles of the present invention, therefore, a unique die lubricant nozzle is provided which directs a continuous annular flow of lubricant to and against an adjacent die ring for lubricating, cooling and cleaning the die ring surfaces. Furthermore, this annular lubricant flow is directly along and against these die ring surfaces and does not depend on the entrance of metal parts being worked entering the die rings and carrying the lubricant thereto as has been prevalent in the prior constructions. Still further, with the novel die lubricant nozzle of the present invention, the annular lubricant flow is along and against the major portion of the die ring surfaces even during a die ring metal working operation taking place so as to insure a constant flow of lubricant during the most critical period of need, again not possible with the prior constructions.

I claim:

1. In a tool pack of the type for use in can bodymakers and the like wherein a ram reciprocal in a die pack opening carries a metallic cup on an end thereof axially through at least one die ring in a working metal forming stroke, the cup is stripped therefrom and the ram moves reversely through the die ring in a return stroke, the die ring in the direction of the forming stroke having a radially inward angled entrance surface terminating at a forming surface followed by a radially outward angled exit surface; the improvement comprising a die lubricant nozzle comprising: a nozzle orifice structure surrounding the die pack opening forwardly axially adjacent the die ring and means for continuously directing lubricant through said nozzle orifice, said nozzle orifice having internal surface means for directing a generally annular flow pattern of lubricant continuously in a generally parallel relationship axially along and against said angled entrance surface of the die ring such that said annular lubricant flow continuously flows axially along and against said die ring entrance surface to said die ring forming surface during presence of the cup in the die ring, and said annular lubricant flow continuously flows axially along and against said die ring entrance surface, over said die ring forming surface and through natural lubricant adherence along said die ring angled exit surface during lack of presence of the cup regardless of the position of the ram in its working and return strokes.

2. In a tool pack as defined in claim 1 in which said nozzle orifice internal surface means includes axially angled, generally parallel, annular surfaces for directing said annular flow pattern of lubricant.

3. In a tool pack as defined in claim 1 in which the die ring has a generally radial leading end surface at least partially exposed generally axially facing said annular nozzle orifice structure; and in which said orifice internal surface means is adapted to direct said annular flow pattern of lubricant partially axially impinging against said die ring exposed leading end surface and partially in said parallel relationship axially along and against said angled entrance surface.

4. In a tool pack as defined in claim 1 in which said nozzle orifice surface means is formed radially outwardly by a separately mounted lubricant distribution ring, the exact positioning thereof at least partially determining size of said nozzle orifice structure and said internal surface means directing of said lubricant annular flow pattern in said parallel relationship axially along and against said angled entrance surface.

5. In a tool pack as defined in claim 1 in which said nozzle orifice internal surface means includes axially angled, generally parallel, annular surfaces directing said annular flow pattern of lubricant; and in which said nozzle orifice surface means is formed radially outwardly by a separately mounted lubricant distribution ring, the exact positioning thereof at least partially determining size of said nozzle orifice structure and said internal surface means directing of said lubricant annular flow pattern in said parallel relationship axially along and against said angled entrance surface.

6. In a tool pack as defined in claim 1 in which the die ring has a generally radial leading end surface at least partially exposed generally axially facing said annular nozzle orifice structure; in which said orifice internal surface means is adapted to direct said annular flow pattern of lubricant partially axially impinging against said die ring exposed leading end surface and partially in said parallel relationship axially along and against said angled entrance surface; and in which said nozzle orifice surface means is formed radially outwardly by a separately mounted lubricant distribution ring, the exact positioning thereof at least partially determining the size of said nozzle orifice structure and said internal surface means directing of said lubricant annular flow pattern.

7. In a method of lubricating and cooling a die ring of the type forming a part of a tool pack of a can bodymaker and the like wherein a ram reciprocates in a die pack opening carrying a metallic cup on an end thereof axially through the die ring in a working metal forming stroke, the cup is stripped therefrom and the ram moves reversely through the die ring in a return stroke, the die ring in direction of the forming stroke having a radially inward angled entrance surface terminating at a forming surface followed by a radially outward angled exit surface; the steps of: during presence of the cup in the die ring, directing a generally annular flow pattern of lubricant continuously in a generally parallel relationship axially along and against said angled entrance surface of the die ring to said die ring forming surface; during a lack of presence of the cup in the die ring and regardless of position of the ram in its working and return strokes, directing said annular lubricant flow pattern continuously flowing in a generally parallel relationship axially along and against said die ring entrance surface over said die ring forming surface and through natural lubricant adherence along said die ring angled exit surface.

8. In a method of lubricating and cooling a die ring as defined in claim 7 in which both said steps of directing said annular lubricant flow pattern include directing said annular lubricant flow pattern in said generally parallel relationship axially along and against said angled entrance surface by axially angled, generally parallel, annular surfaces.

9. In a method of lubricating and cooling a die ring as defined in claim 7 in which both said steps of directing said annular lubricant flow pattern include impinging a portion of said annular lubricant flow pattern against a generally radial leading end surface of the die ring while directing a portion thereof in said generally parallel relationship axially along and against said angled entrance surface.

10. In a method of lubricating and cooling a die ring as defined in claim 7 in which both said steps of directing said annular lubricant flow pattern include at least partially determining exact size and direction of said annular lubricant flow pattern by selectively removably mounting of generally radially inwardly facing surfaces forming a generally radially outward boundary for said annular lubricant flow pattern axially along and against said angled entrance surface.

11. In a method of lubricating and cooling a die ring as defined in claim 7 in which both said steps of directing said annular lubricant flow pattern include directing said annular lubricant flow pattern in said generally parallel relationship axially along and against said angled entrance surface by axially angled, generally parallel, annular surfaces; at least partially determining exact size and direction of said annular lubricant flow pattern by selectively removably mounting of generally radially inwardly facing surfaces forming a generally radially outward boundary for said annular lubricant flow pattern axially along and against said angled entrance surface.

12. In a method of lubricating and cooling a die ring as defined in claim 7 in which both said steps of directing said annular lubricant flow pattern include impinging a portion of said annular lubricant flow pattern against a generally radial leading end surface of the die ring while directing a portion thereof in said generally parallel relationship axially along and against said angled entrance surface; at least partially determining exact size and direction of said annular lubricant flow pattern by selectively removably mounting of generally radially inwardly facing surfaces forming a generally radially outward boundary for said annular lubricant flow pattern axially along and against said angled entrance surface.

* * * * *